US007902476B2

(12) United States Patent
Querejeta Andueza et al.

(10) Patent No.: US 7,902,476 B2
(45) Date of Patent: Mar. 8, 2011

(54) IGNITION SWITCH ASSEMBLY FOR A GAS VALVE

(75) Inventors: Félix Querejeta Andueza, Vitoria-Gasteiz (ES); Javier Echenagusia Saez de Zaitegui, Aretxabaleta (ES)

(73) Assignee: Coprecitec, S.L., Aretxabaleta (Gipuzkoa) (ES)

( * ) Notice: Subject to any disclaimer, the term of this patent is extended or adjusted under 35 U.S.C. 154(b) by 182 days.

(21) Appl. No.: 12/367,386

(22) Filed: Feb. 6, 2009

(65) Prior Publication Data

US 2010/0035195 A1 Feb. 11, 2010

(30) Foreign Application Priority Data

Aug. 6, 2008 (ES) ..... 200801698 U

(51) Int. Cl.
*H01H 19/20* (2006.01)

(52) U.S. Cl. ..... 200/569; 200/574; 431/256

(58) Field of Classification Search ..... 200/569, 200/61.86, 574; 431/256; 126/25 B, 42
See application file for complete search history.

(56) References Cited

U.S. PATENT DOCUMENTS

| | | | | |
|---|---|---|---|---|
| 2,552,141 | A * | 5/1951 | Bramley | 200/19.03 |
| 3,202,842 | A * | 8/1965 | Sherwood | 307/141 |
| 3,436,165 | A * | 4/1969 | Gehrke | 431/256 |
| 3,502,835 | A * | 3/1970 | Batcheller | 200/469 |
| 4,019,855 | A | 4/1977 | Camillo | |
| 5,525,771 | A * | 6/1996 | Lund | 200/61.86 |

* cited by examiner

*Primary Examiner* — Edwin A. Leon
*Assistant Examiner* — Vanessa Girardi
(74) *Attorney, Agent, or Firm* — Tim L. Kitchen; Peter B. Scull; Berenbaum Weinshienk PC

(57) ABSTRACT

An ignition switch assembly connectable to a rotary shaft of a gas tap of a cooking device. The ignition switch assembly has a coupling element connectable to the rotary shaft of the gas tap, a fixed contact, a mobile contact, and a cam coupled to the coupling element which is configured to move the mobile contact relative to the fixed contact. The cam has a guide that is moveable within a groove of the switch assembly which controls the lateral displacement of the cam in relation to the coupling element so that the lateral displacement of the cam is controlled such that when the coupling element is rotated in a first direction, electrical contact between the mobile and fixed contacts is achievable, but when the coupling element is rotated in a second direction opposite the first direction the lateral displacement of the cam is controlled to prevent electrical contact between the mobile and fixed contacts.

20 Claims, 6 Drawing Sheets

IGNITION SWITCH ASSEMBLY FOR A GAS VALVE

CROSS-REFERENCE TO RELATED APPLICATIONS

This application claims priority to Spanish Patent Application No. U200801698, filed Aug. 6, 2008.

TECHNICAL FIELD

The present invention relates to a gas tap with ignition switch adapted to a household cooker.

BACKGROUND

There are known gas taps, adapted mainly to a household gas cooker, which comprise a safety valve inserted into a body of the tap, a rotatory shaft and an ignition switch that is operated when the user turns the rotatory shaft in a specific direction to generate the ignition of the flame, whereas when the user turns the rotatory shaft in the opposite direction, the ignition is not generated.

U.S. Pat. No. 4,019,855 discloses a gas tap that comprises a rotatory shaft, a cam connected to the rotatory shaft, a plate-type ignition switch with a fixed first terminal and a second terminal that moves, driven by the cam, towards the first terminal to generate the ignition. The cam includes a radial first projection disposed centrally and delimited by two parallel ramps, and a second projection that is disposed adjacent to the first projection, with the result that when the gas tap is turned in a direction of ignition the second terminal is moved by means of the ramp of the cam until the second projection causes the second terminal to come into contact with the terminal. If the tap is turned in an opposite direction to the ignition, the second terminal is moved by means of the ramp of the cam, and does not encounter during its stroke any other projection that moves it towards the first terminal, as a result of which contact is not generated.

SUMMARY OF THE DISCLOSURE

An object of this invention is to provide an ignition switch assembly or a gas tap with an ignition switch adapted to household cookers as defined in the claims.

In one embodiment, an ignition switch assembly that is connectable to a rotary shaft of a gas tap of a cooking device is provided. The ignition switch assembly including a coupling element connectable to the rotary shaft, the ignition switch assembly having a fixed contact, a mobile contact, and a cam coupled to the coupling element which is configured to move the mobile contact relative to the fixed contact, the cam having a guide moveable within a groove of the switch assembly that controls the lateral displacement of the cam in relation to the coupling element, the lateral displacement of the cam controlled such that when the coupling element is rotated in a first direction from a first initial position, the mobile contact is moveable into electrically contact with the fixed contact, whereas when the coupling element is rotated in a second direction opposite the first direction the lateral displacement of the cam is controlled to prevent electrical contact between the mobile and fixed contacts.

In another embodiment, a gas tap is provided that comprises a rotatory shaft, an ignition switch coupled to the rotatory shaft, the ignition switch including fixed contact and mobile contact means, and a cam coupled to the rotatory shaft that moves the mobile contact means towards the fixed contact means, the electrical contact being generated when the rotatory shaft is turned in a specific direction from an initial closed position of the gas tap, whereas when the rotatory shaft is turned in an opposite direction the electrical contact of the switch is not generated.

To achieve this, the cam comprises a guide or guide means that guides the lateral movement of the cam in relation to the rotatory shaft. This way a simple, optimized and of an easy maintenance gas tap is achieved.

These and other advantages and characteristics of the invention will be made evident in the light of the drawings and the detailed description thereof.

DETAILED DESCRIPTION

Figure 1:
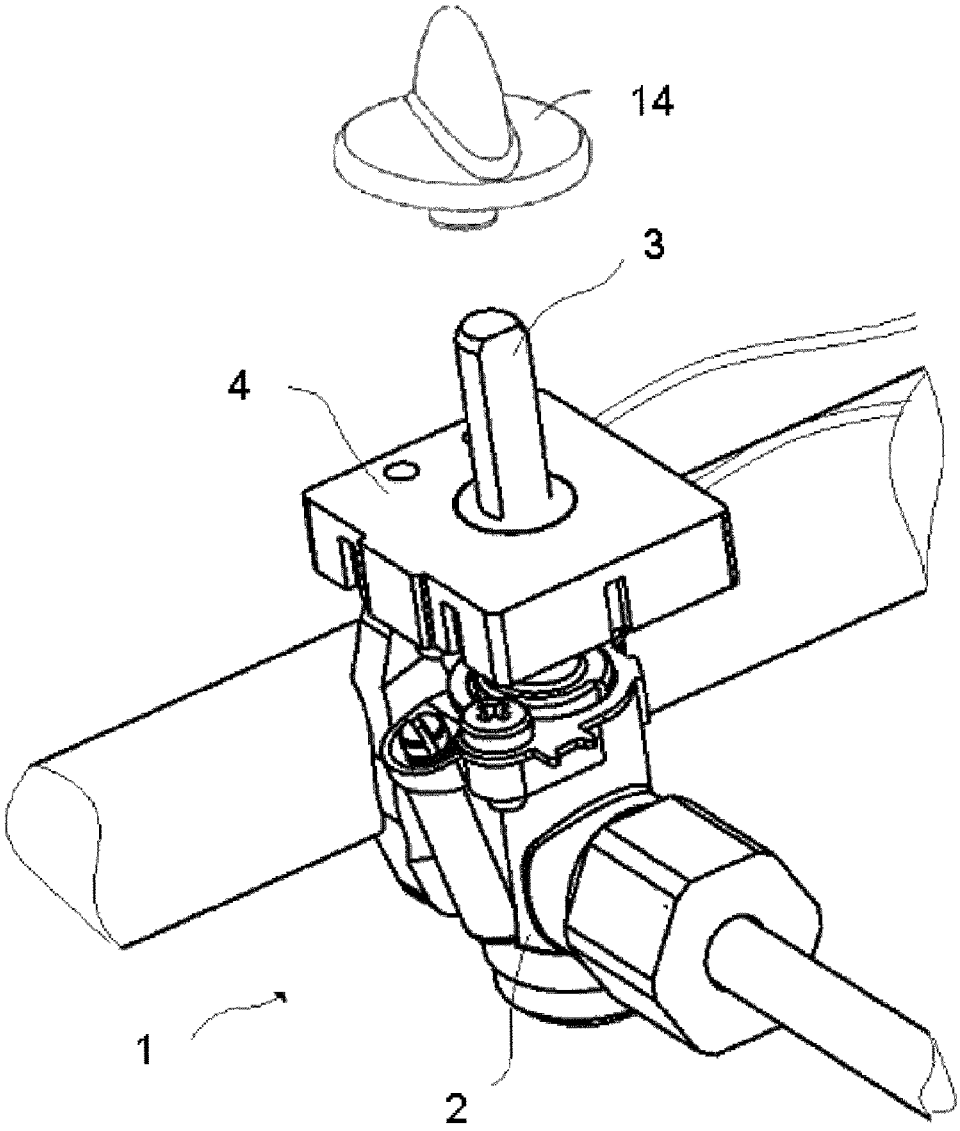
FIG. 1 is a perspective view of a gas tap with an ignition switch according to an embodiment of the present invention.

FIG. 1 partially shows a gas tap 1 according to an embodiment of the present invention, adapted to a household gas cooker not shown in the figures, which comprises burners, the flow of the air/gas mixture supplying the respective burner and the ignition of the air/gas mixture being controlled by means of an ignition switch assembly of the gas tap 1.

The gas tap 1 comprises a body 2, a gas valve that is housed inside the body 2 and which controls the flow of the air/gas mixture supplied to the respective burner, a rotatory shaft 3 coupled coaxially to the gas valve and a control knob 14, coupled at one free end of the rotatory shaft 3, and by means of which a user may control the flow of the air/gas mixture by means of the rotation of the control knob 14.

Figure 2:
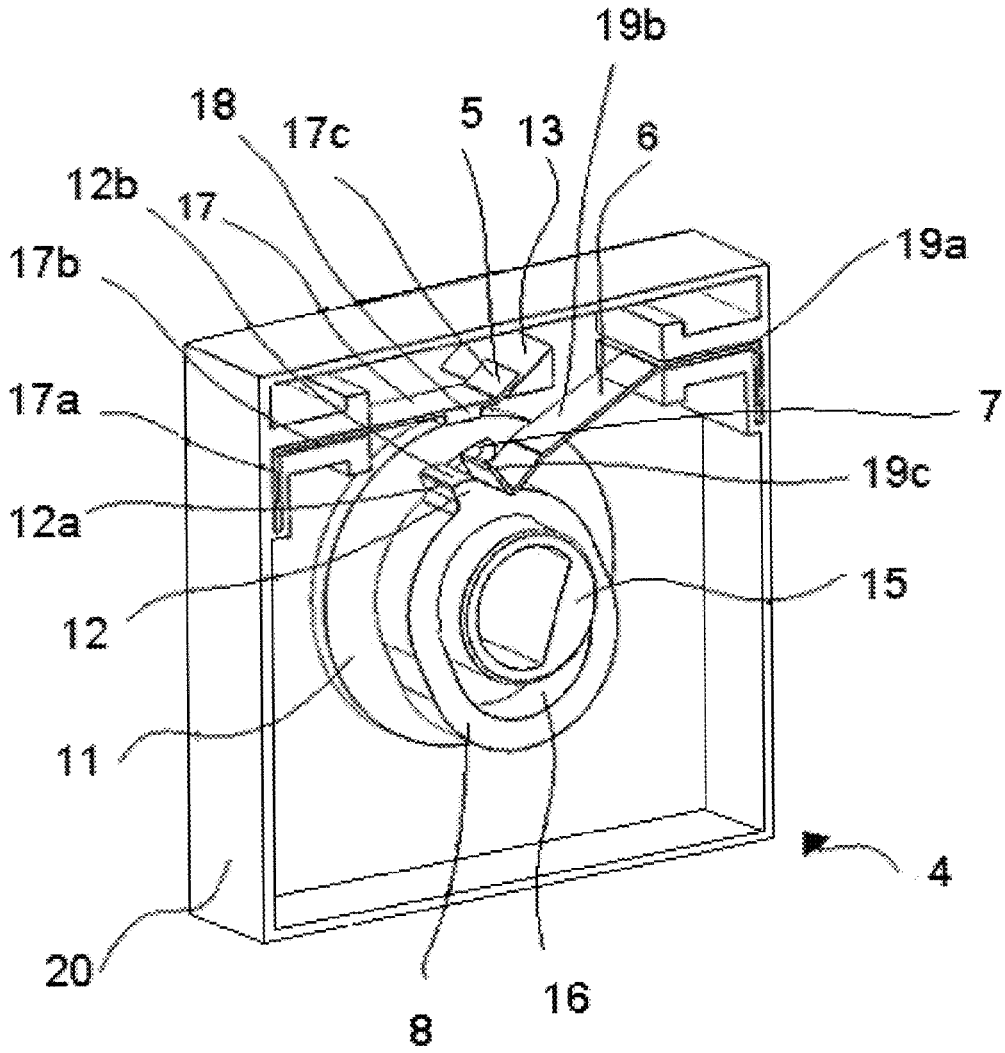
FIG. 2 is a perspective view of the ignition switch shown in FIG. 1.

In addition, the gas tap 1 comprises an ignition switch 4, a preferred embodiment shown in detail in FIG. 2, which preferably comprises a casing 20 that may be fixed to the household cooker, a fixed contact/fixed contact means 5, a flexible mobile contact/flexible mobile contact means 6 that is moved towards the fixed contact 5 in order to generate an electrical contact between them, a coupling element 15 connected to the rotatory shaft 3, and a cam 8, coupled to the coupling element 15. The fixed contact 5, the mobile contact 6, the cam 8 and the coupling element 15 are housed inside the casing 20.

Figure 3:
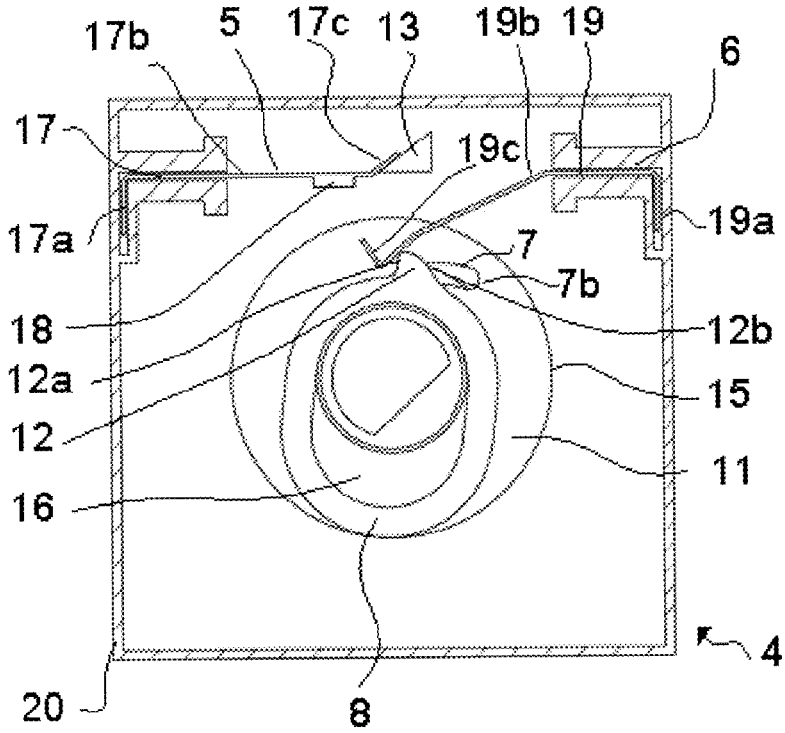
FIG. 3 is a cross-sectional view of the gas tap shown in FIG. 1 in an initial closed position of the gas tap.

When the user opens the gas tap 1, rotating the rotatory shaft 3 in a counter-clockwise direction from an initial closed position of the gas tap, as shown in FIG. 3, the cam 8 moves the mobile contact 6 towards and into contact with the fixed contact 5, thereby creating an electrical contact between them. On the contrary, when the user turns the rotatory shaft 3 in a clockwise direction, an electrical contact between mobile contact 6 and fixed contact 5 is not obtainable. Thus, when a user operates the gas tap by turning the rotary shaft in one direction an ignition is achievable, whereas when the rotary shaft is rotated in the opposite direction an ignition is not achievable. As a result, in the event that the flame goes out at any given moment and gas continues to flow through the gas tap, the user may close the gas tap 1 with no danger of the ignition switch 4 generating sparks, with the subsequent risk of explosion, as the ignition switch 4 only operates in the direction of opening of the gas tap 1.

Figure 9:
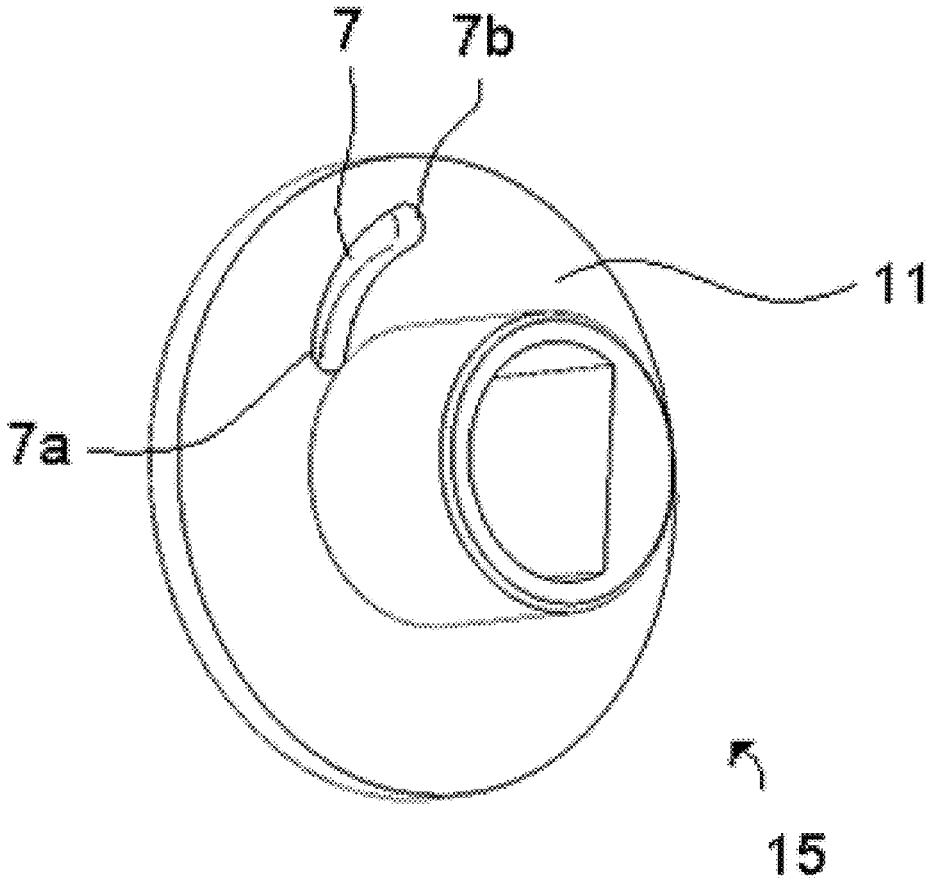
FIG. 9 is a perspective view of an element coupling the ignition switch to the gas tap shown in FIG. 1

The coupling element 15, shown in detail in FIG. 9, is preferably substantially cylindrical and preferably comprises a base 11 that is supported on the casing 20, the coupling element 15 being fixed in connection to the rotatory shaft 3.

Figure 8:
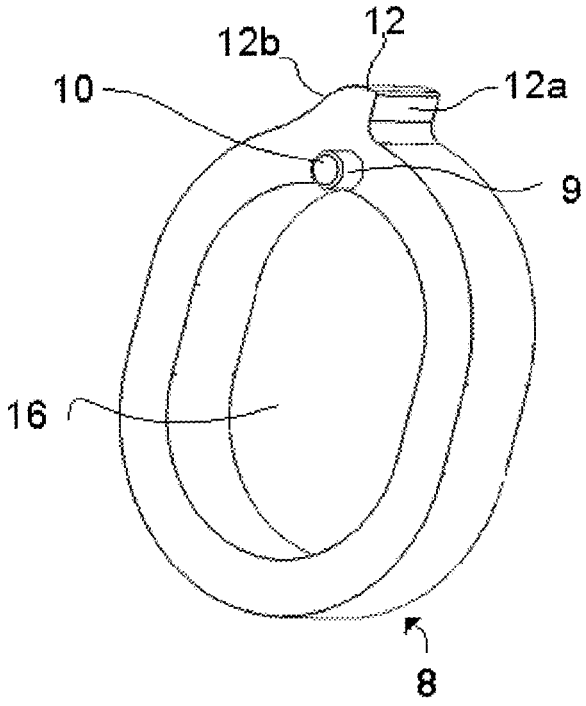
FIG. 8 is a perspective view of a cam built into the ignition switch shown in FIG. 1.

In addition, the cam 8, shown in detail in FIG. 8, is an eccentric cam that is supported on the base 11 of the coupling element 15, and includes a closed eccentric or wide hole 16 inside which the coupling element 15 is tightly housed, the cam 8 being capable of moving in relation to the coupling element 15 and, therefore, to the rotatory shaft 3 all the way along the hole 16.

The cam 8 also includes a protrusion or stop 12 that extends radially in relation to the rotatory shaft 3 or peripheral surface of the cam, and which is configured to move the mobile contact 6 towards the fixed contact 5. In one embodiment, the protrusion/stop 12 is delimited by a first surface 12*a* that extends in a radial direction and a second curved surface 12*b* continuous to the first surface 12*a*.

The cam 8 comprises a guide/guide means 9 that guides the lateral movement of the cam 8 in relation to the rotatory shaft 3 or coupling element 15. The guide 9 comprises a projection 10 that extends in the axial direction of the rotatory shaft 3 or coupling element 15, and the base 11 of the coupling element 15 includes a closed and preferably curved groove 7 in which the projection 10 is housed, the projection 10 being guided as it moves in the groove 7 when the rotatory shaft 3 or coupling element 15 is rotated.

In one embodiment, the fixed contact 5 comprises a fixed metallic member or plate 17 that includes a first end 17*a* that is inserted in the casing 20, an intermediate part 17*b* that is preferably disposed substantially orthogonal to the rotatory shaft 3 and which includes a contact area 18 that may project out in relation to the intermediate part 17*b*, and a second end 17*c* that preferably forms a substantially 45° angle in relation to the intermediate part 17*b* and which acts as a stop against a support 13 that projects out of the casing 20 in the axial direction. In the initial closed position of the gas tap, shown in FIG. 3, the intermediate part 17*b* and the contact area 18 are preferably disposed substantially orthogonal to the rotatory shaft 3.

In one embodiment, the mobile contact 6 comprise a flexible metallic member or plate 19 that includes a first end 19*a* that is preferably inserted substantially orthogonal in relation to the rotatory shaft 3 in the casing 20, an intermediate part 19*b* that forms an angle in relation to the first end 19*a*, and a second end 19*c* that is preferably substantially orthogonal to the intermediate part 19*b*.

FIG. 3 shows the gas tap 1 closed, with the projection 10 of the cam 8 positioned on a first end 7*a* of the groove 7 in the base 11 of coupling element 15. Starting from this position, when the user turns the control knob 14 in a counter-clockwise direction, the first surface 12*a* of the protrusion/stop 12 comes into contact with the intermediate part 19*b* of the flexible metallic member 19, thereby moving it until the second end 19*c* of the flexible metallic member 19 comes into contact with the contact area 18 of the fixed metallic member 17, thereby enabling the generation of an ignition. At the same time, the projection 10 of the cam 8 is guidely displaced along the groove 7 to a second end 7*b*, and the cam 8 moves in relation to the rotatory shaft 3 or coupling means 15 all the way along the hole 16, as shown in FIG. 4.

Figure 4:
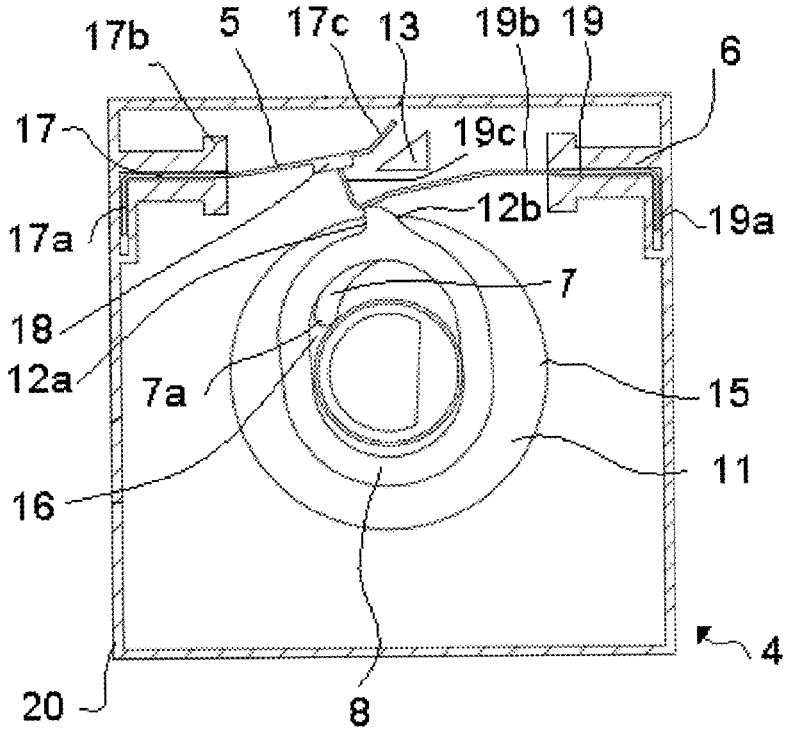
FIG. 4 is a cross-sectional view of the gas tap shown in FIG. 1 in a first position when a control of the gas tap is turned in a counter-clockwise direction.
Figure 5:
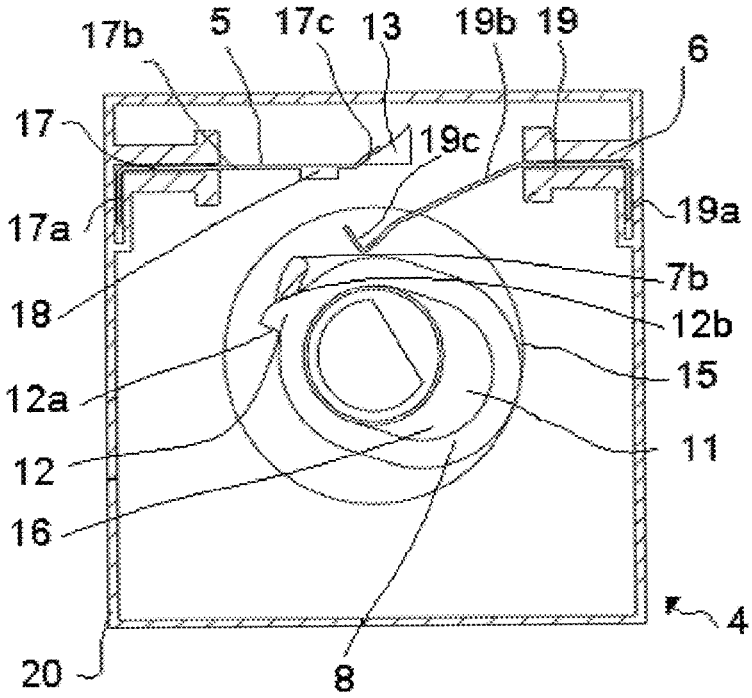
FIG. 5 is a cross-sectional view of the gas tap shown in FIG. 1 in a second position when a control of the gas tap is turned in a counter-clockwise direction.

Starting from the position shown in FIG. 4, if the user continues turning the control knob 14 in a counter-clockwise direction, the flexible metallic member 19 separates from the fixed metallic member 17 and the projection 10 of the cam 8 is guidely displaced along the groove 7 positioning itself again on the first end 7*a* of the groove 7, as shown in FIG. 5.

Figure 6:
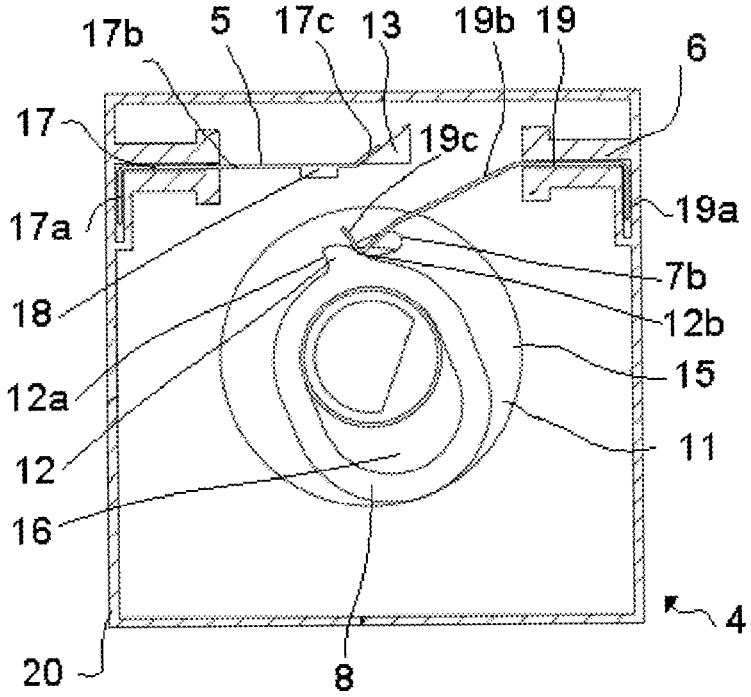
FIG. 6 is a cross-sectional view of the gas tap shown in FIG. 1 in a first position when a control of the gas tap is turned in a clockwise direction.
Figure 7:
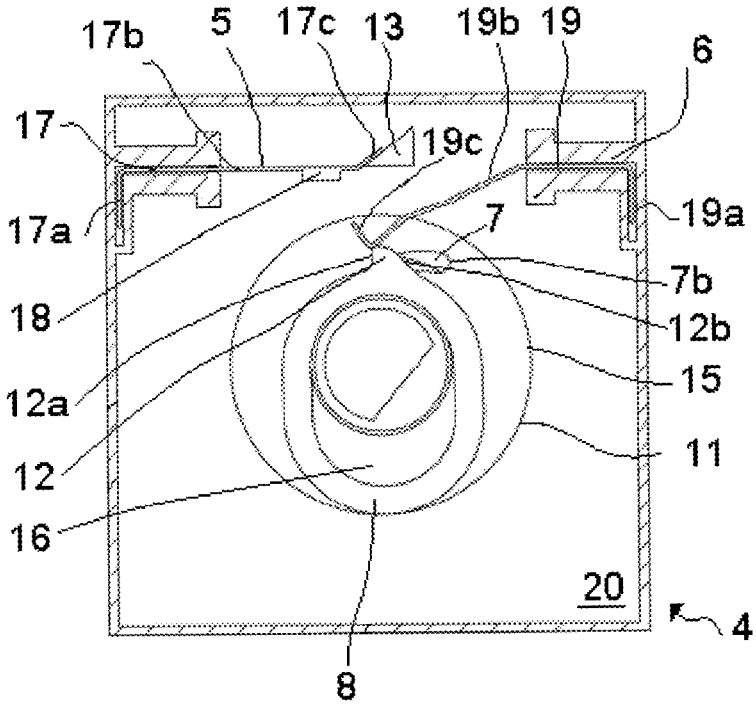
FIG. 7 is a cross-sectional view of the gas tap shown in FIG. 1 in a second position when a control of the gas tap is turned in a clockwise direction.

FIGS. 6 and 7 show how the gas tap 1 works when the user turns the control knob 14 in a clockwise direction in the direction of closure of the gas tap 1. Starting from the position shown in FIG. 5, when the user turns the control knob 14 in a clockwise direction, the second surface 12*b* of the protrusion/stop 12 of the cam 8 comes into contact with the second end 19*c* of the flexible metallic member 19, thereby moving it towards the fixed metallic member 17, without losing contact with the second surface 12*b*. At the same time, the projection 10 of the cam 8 remains fixed in relation to the rotatory shaft 3 or coupling element 15 and as a result, even though the flexible metallic member 19 moves towards the fixed metallic member 17, the electrical contact between mobile contact 6 and fixed contact 5 is not achieved, as shown in FIG. 7.

In other embodiments not shown here, the ignition switch 4 may be built into the body 2 of the gas tap 1.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. An ignition switch assembly connectable to a rotary shaft of a gas tap of a cooking device comprising:

a coupling element connectable to the rotary shaft, the ignition switch assembly having a fixed contact, a mobile contact, and a cam coupled to the coupling element which is configured to move the mobile contact relative to the fixed contact, the cam having a guide moveable within a groove of the switch assembly that controls lateral displacement of the cam in relation to the coupling element, lateral displacement of the cam controlled such that when the coupling element is rotated in a first direction from a first initial position, the mobile contact is moveable to electrical contact with the fixed contact, whereas when the coupling element is rotated in a second direction opposite the first direction the lateral displacement of the cam is controlled to prevent electrical contact between the mobile and fixed contacts.

2. An ignition switch assembly according to claim 1 wherein the groove is curved.

3. An ignition switch assembly according to claim 1 wherein the cam comprises an eccentric peripheral surface with a protrusion that extends radially from a portion thereof, the protrusion engageable with the mobile contact to cause the mobile contact to move towards the fixed contact when the coupling element is rotated in the first and second directions.

4. An ignition switch assembly according to claim 3 wherein the mobile contact is moveable by the protrusion to contact the fixed contact when the coupling element is rotated in the first direction and wherein the mobile contact is moveable by the protrusion towards the fixed contact but unable to make contact with the fixed contact when the coupling element is rotated in the second direction.

5. An ignition switch assembly according to claim 1 wherein the cam has an eccentric peripheral surface and an eccentric hole, the eccentric peripheral surface having a protrusion extending radially from a portion thereof, the coupling element fitted within the eccentric hole such that rotation of the coupling element causes rotational and lateral movement of the eccentric peripheral surface of the cam, the guide controlling the lateral movement of the eccentric peripheral surface relative to the coupling element.

6. An ignition switch assembly according to claim 1 wherein the groove is curved and the cam has an eccentric peripheral surface and an eccentric hole, the eccentric peripheral surface having a protrusion extending radially from a portion thereof, the coupling element fitted within the eccentric hole such that rotation of the coupling element causes rotational and lateral movement of the eccentric peripheral surface of the cam, the guide controlling the lateral movement of the eccentric peripheral surface relative to the coupling element, the mobile contact moveable by the protrusion to contact the fixed contact when the coupling element is rotated in the first direction and wherein the mobile contact is moveable by the protrusion towards the fixed contact but unable to make contact with the fixed contact when the coupling element is rotated in the second direction.

7. An ignition switch assembly according to claim 1 wherein the initial position of the coupling element corresponds to a closed position of the gas tap.

8. An ignition switch assembly according to claim 1 wherein the coupling element, the cam, the fixed contact and the mobile contact are housed inside a casing.

9. An ignition switch assembly according to claim 1 wherein the fixed and mobile contacts are attached to the casing.

10. An ignition switch assembly according to claim 8 wherein the casing is attachable to the cooking device.

11. A gas tap for a cooking appliance comprising:

a gas valve housed inside a valve body configured to control the flow of gas to the cooking appliance, a rotary shaft connected to the gas valve, an ignition switch assembly coupled to the rotary shaft, the ignition switch having a fixed contact, a mobile contact, and a cam coupled to the rotary shaft which is configured to move the mobile contact relative to the fixed contact, the cam having a guide moveable within a groove of the switch assembly that controls the lateral displacement of the cam in relation to the rotary shaft, lateral displacement of the cam controlled such that when the rotary shaft is rotated in a first direction from an initial closed position of the gas valve, the mobile contact is moveable to electrical contact with the fixed contact, whereas when the rotary shaft is rotated in a second direction opposite the first direction the lateral displacement of the cam is controlled to prevent electrical contact between the mobile and fixed contacts.

12. A gas tap according to claim 11 wherein the groove is curved.

13. A gas tap according to claim 11 wherein the cam comprises an eccentric peripheral surface with a protrusion that extends radially from a portion thereof, the protrusion engageable with the mobile contact to cause the mobile contact to move towards the fixed contact when the rotary shaft is moved in the first and second directions.

14. A gas tap according to claim 13 wherein the mobile contact is moveable by the protrusion to contact the fixed contact when the rotary shaft is rotated in the first direction and wherein the mobile contact is moveable by the protrusion towards the fixed contact but unable to make contact with the fixed contact when the rotary shaft is rotated in the second direction.

15. A gas tap according to claim 11 wherein the ignition switch assembly includes a coupling element that connects the cam to the rotary shaft, the cam having an eccentric peripheral surface and an eccentric hole, the eccentric peripheral surface having a protrusion extending radially from a portion thereof, the coupling element fitted within the eccentric hole such that rotation of the coupling element causes rotational and lateral movement of the eccentric peripheral surface of the cam, the guide controlling the lateral movement of the eccentric peripheral surface relative to the coupling element.

16. A gas tap according to claim 15 wherein the coupling element, the cam, the fixed contact and the mobile contact are housed inside a casing.

17. A gas tap according to claim 15 wherein the coupling element, the cam, the fixed contact and the mobile contact are housed inside the valve body.

18. A gas tap according to claim 15 wherein the casing is attachable to the cooking device.

19. An ignition switch assembly connectable to a shaft of a gas tap of a cooking device comprising:

a coupling element adapted to be connected and rotated by the shaft of the gas tap, the coupling element having a base with a curved groove disposed therein, a cam having an eccentric peripheral surface and an eccentric hole, the eccentric peripheral surface having a protrusion extending radially from a portion thereof, the coupling element fitted within the eccentric hole such that rotation of the coupling element causes rotational and lateral movement of the eccentric peripheral surface of the cam, the cam having a guide fitted within the curved groove of the base that guides the lateral movement of the cam in relation to the coupling element, a fixed contact fixed in relation to the cam: and a mobile contact engageable with the eccentric peripheral surface of the cam and moveable between a contact relationship and a non-contact relationship with the fixed contact, the coupling element, the curved groove, the eccentric peripheral surface, the eccentric hole, the guide, the protrusion, the fixed contact and the mobile contact being situated relative to one another and configured such that when the coupling element is in an initial position the mobile and fixed contacts are in the non-contact relationship and wherein a first rotation of the coupling element in a first direction causes the mobile contact to engage with the protrusion of the cam to cause the mobile and fixed contacts to be in the contact relationship and wherein further rotation of the coupling element in the first direction beyond the first rotation causes the mobile contact to disengage with the protrusion to cause the mobile and fixed contacts to be in the non-contact relationship and wherein a subsequent rotation of the coupling element in a second direction opposite the first direction back to the initial position causes the mobile and fixed contacts to be in the non-contact relationship during the entire subsequent rotation.

20. An ignition switch assembly according to claim 19 wherein the coupling element, the cam, the fixed contact and the mobile contact are housed inside a casing that is attachable to the cooking device.

* * * * *